US011572141B2

(12) United States Patent
Smith

(10) Patent No.: US 11,572,141 B2
(45) Date of Patent: Feb. 7, 2023

(54) LIFT BAG WITH AUTOMATIC GAS VOLUME REGULATION

(71) Applicant: Kevin R. Smith, Saint Paul, IN (US)

(72) Inventor: Kevin R. Smith, Saint Paul, IN (US)

( * ) Notice: Subject to any disclaimer, the term of this patent is extended or adjusted under 35 U.S.C. 154(b) by 128 days.

(21) Appl. No.: 17/335,583

(22) Filed: Jun. 1, 2021

(65) Prior Publication Data

US 2021/0380208 A1 Dec. 9, 2021

Related U.S. Application Data

(60) Provisional application No. 62/704,913, filed on Jun. 3, 2020.

(51) Int. Cl.
*B63C 7/10* (2006.01)
*B63C 7/02* (2006.01)

(52) U.S. Cl.
CPC ..... *B63C 7/10* (2013.01); *B63C 7/02* (2013.01); *B63B 2207/02* (2013.01); *B63B 2207/04* (2013.01)

(58) Field of Classification Search
CPC ..... B63C 7/02; B63C 7/10; B63B 2207/02; B63B 2207/04
USPC ..... 114/51, 52, 54
See application file for complete search history.

(56) References Cited

U.S. PATENT DOCUMENTS

| | | | | |
|---|---|---|---|---|
| 3,512,493 | A | 5/1970 | Hallanger | |
| 3,631,551 | A | 1/1972 | Miller | |
| 3,659,299 | A * | 5/1972 | Davidson | B63C 7/00 114/54 |
| 3,940,814 | A | 3/1976 | Bayles | |
| 4,510,878 | A | 4/1985 | Breedlove | |
| 4,658,745 | A * | 4/1987 | Buecher | B63C 7/10 114/54 |
| 4,979,451 | A | 12/1990 | Searle | |
| 6,772,705 | B2 | 8/2004 | Leonard | |
| 9,254,899 | B2 | 2/2016 | Sparks | |

* cited by examiner

*Primary Examiner* — Daniel V Venne
(74) *Attorney, Agent, or Firm* — Woodard, Emhardt, Henry, Reeves & Wagner, LLP

(57) ABSTRACT

A lift bag for moving an object underwater includes a lift bag body and a buoyancy regulator device within an internal cavity of the lift bag body. The buoyancy regulator device includes concentric regulator tubes. Each regulator tube includes a regulator tube opening and the regulator tube openings may be aligned to define a regulator tube aperture. The regulator tube aperture is in fluid communication with a lift bag slot formed in the lift bag body. A constant buoyancy for the lift bag is determined by adjusting the position of the regulator tube aperture by moving the inner and outer regulator tubes with respect to each other.

20 Claims, 17 Drawing Sheets

LIFT BAG WITH AUTOMATIC GAS VOLUME REGULATION

CROSS REFERENCE TO RELATED APPLICATIONS

The present patent document claims the benefit of the filing date of Provisional U.S. Patent Application No. 62/704,913, filed on Jun. 3, 2020, which is hereby incorporated by reference in its entirety.

BACKGROUND

Lifting or moving heavy objects underwater can be accomplished using lift bags. The buoyancy of the lift bag is used to move the object vertically underwater or to assist with using the object horizontally underwater. One common danger with the use of a lift bag is the risk of runaway if the buoyancy force of the lift bag is too great in comparison to the weight of the object to be moved. Runaway creates an uncontrolled descent or ascent that could cause injury to divers or could cause damages to the object to be moved or to support structures on the surface of the water. The expansion of air within the lift bag during ascent due to decreasing water pressure causes an increase in the buoyancy force provided by the lift bag. The increasing buoyancy force creates a substantial risk of runaway if not properly controlled.

Many commercially available lift bags include a valve that may be manually operated by a diver to control buoyancy during ascent. However, this can be a dangerous operation, as there is a risk of entanglement with the diver's breathing equipment if the lift bag starts to uncontrollably rise or sink if the valve is operated incorrectly. Additionally, the diver has to continuously monitor the valve as the water pressure surrounding the lift bag changes as the water depth of the lift bag changes.

Thus, there is a need for improvement in this field.

SUMMARY

Certain embodiments include a lift bag for moving or lifting an object while that object is underwater. In one form, the lift bag includes a lift bag body defining an internal cavity. A lift bag slot is defined through a portion of the lift bag body. The lift bag slot allows fluid communication between the internal cavity of the lift bag body and the external environment.

A buoyancy regulator device is positioned within the internal cavity of the lift bag body. The buoyancy regulator device includes an outer regulator tube that has a hollow outer regulator tube body that defines an outer regulator interior. An outer regulator tube opening is defined through the outer regulator tube body. The outer regulator tube opening is in fluid communication with the outer regulator interior.

The buoyancy regulator device also includes an inner regulator tube that has a hollow inner regulator tube body that defines an inner regulator interior. An inner regulator tube opening is defined through the inner regulator tube body and the inner regulator tube opening is in fluid communication with the inner regulator interior. The inner regulator tube fits concentrically within the outer regulator tube.

When the inner regulator tube is fit concentrically within the outer regulator tube, the outer regulator tube opening is configured to align with the inner regulator tube opening to create a regulator tube aperture. The position of the regulator tube aperture is adjustable by moving the inner regulator tube with respect to the outer regulator tube.

The buoyancy regulator device is positioned within the internal cavity of the lift bag body so that the outer regulator tube opening is aligned with the lift bag slot so that the lift bag slot is in fluid communication with the regulator tube aperture. This alignment allows excess air within the internal cavity of the lift bag body to be expelled through the regulator tube aperture and the lift bag slot. The buoyancy force of the lift bag can be changed by adjusting the position of the regulator tube aperture.

In another form, a buoyancy regulator device for a lift bag comprises an outer regulator tube including an outer regulator tube body that defines an outer regulator tube interior. A plurality of outer regulator tube holes is defined through the outer regulator tube body. An outer regulator tube hole axis is defined through the outer regulator tube holes.

An inner regulator tube includes an inner regulator tube body that defines an inner regulator tube interior. The inner regulator tube is configured to fit concentrically within the outer regulator tube interior. A plurality of inner regulator tube holes are defined through the inner regulator tube body. The inner regulator tube holes are aligned along an inner regulator tube hole axis that is oblique to the outer regulator tube hole axis when the inner regulator tube is concentric with the outer regulator tube. One of the inner regulator tube or the outer regulator tube may be rotated with respect to the other regulator tube when the inner regulator tube is fit concentrically within the outer regulator tube interior. This rotation aligns one of the inner regulator tube holes with a corresponding outer regulator tube holes to determine a buoyancy force provided by the lift bag.

In some embodiments, the inner regulator tube is rotatable with respect to the outer regulator tube. Typically, in these embodiments, the outer regulator tube hole axis is substantially parallel to a sidewall of outer regulator tube body. In other embodiments, the outer regulator tube is rotatable with respect to the inner regulator tube. Typically, in these embodiments the inner regulator tube hole axis is substantially parallel to a sidewall of inner regulator tube body.

In other aspect, a buoyancy regulator device for a lift bag comprises an outer regulator tube including an outer regulator tube body that defines an outer regulator tube interior. An inner regulator tube including an inner regulator tube body is configured to fit concentrically within the outer regulator tube interior. The outer regulator tube and the inner regulator tube are mechanically coupled by a stud fit into a tube slot. The tube slot includes a length and a plurality of tube slot arms extending from the tube slot each at a different position along the length of the tube slot.

When the stud is aligned with one of the tube slot arms along the length of the tube slot, the outer regulator tube and the inner regulator tube may be rotated with respect to each other so that the stud enters the tube slot arm. A buoyancy force of the lift bag is adjusted by positioning the stud within a different tube slot arm. In some embodiments, the tube slot is defined through the outer regulator tube and the stud extends from the inner regulator tube. In other embodiments, the tube slot is defined through the inner regulator tube and the stud extends from the outer regulator tube.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
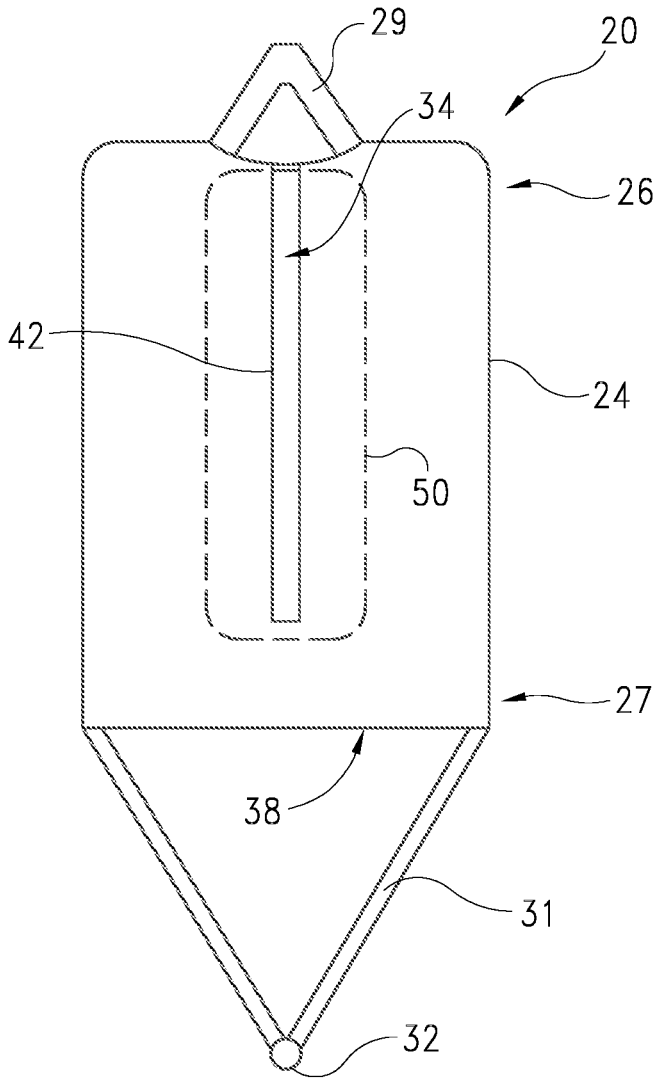
FIG. 1 illustrates a front elevation view of a lift bag for use with controlling the movement of objects underwater.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 illustrates an embodiment of a lift bag 20 that is used to help control the movement of objects underwater. Lift bag 20 may be used to assist with lifting objects that are underwater to the surface of the water or may be used to control the descent of an object from the surface to a desired position underwater. Lift bag 20 may also be used to assist with moving objects laterally underwater.

The lift bag 20 includes a lift bag body 24 that has a top portion 26 and a bottom portion 27. The lift bag body 24 is preferably made from a durable fabric that is impervious to both air and water. An upper strap 29 is attached at the top portion 26 of lift bag body 24 and a lower strap 31 is attached at the bottom portion 27 of lift bag body 24. An eyelet 32 is positioned on lower strap 31 and provides a connection point for connecting lower strap 31 to an object to be lifted by lift bag 20.

An opening 38 is defined in the bottom portion 27 of the lift bag body 24 to allow access to and from an internal cavity 34 that is defined by the lift bag body 24 of lift bag 20. When the lift bag 20 is submerged underwater, the internal cavity 34 may be partially filled with water and partially filled with air that provides the buoyancy force that allows the lift bag 20 to lift an object that is underwater.

A lift bag slot 42 is defined through a portion of lift bag body 24 and extending from the top portion 26 of lift bag body 24 toward the bottom portion 27 of lift bag body 24. The lift bag slot 42 allows the internal cavity 34 of lift bag 20 to be in fluid communication with the outside environment. The lift bag slot 42 is aligned with a buoyancy regulator device 50 (shown in phantom lines in FIG. 1) that is positioned within the internal cavity 34 of lift bag 20. Buoyancy regulator device 50 may be connected to lift bag body 24 by sewing a connection between buoyancy regulator device 50 and lift bag body 24, by the use of adhesive, using a flange type connection, or any other suitable attachment method.

When lift bag 20 is submerged underwater, internal cavity 34 is initially filled with water. The object to be lifted is attached to the lift bag 20, for example at the eyelet 32 on lower strap 31. Then, an air source, such as the air supply of the diver, is used to introduce air into internal cavity 34 through the opening 38 at the bottom portion 27 of lift bag body 24. In other embodiments, any other suitable alternative source of air may be used, such as a portable air source like a separate compressed air cylinder. In other examples, a hose may be extended from an air source on a boat or platform at the surface of the water and the hose may be used to supply air to the internal cavity 34 of lift bag 20. The air introduced into internal cavity 34 displaces at least a portion of the water filling the internal cavity 34 and provides a buoyancy force that is capable of lifting the object that is attached to lift bag 20.

The amount of buoyancy force that is created is directly proportional to the volume of air within internal cavity 34. According to Boyle's Law, during ascent, as the lift bag 20 rises and the depth of the water decreases, the water pressure on the lift bag 20 also decreases. The decrease in water pressure allows the air within the internal cavity 34 to expand. This expansion of air within the internal cavity 34 increases the volume of the air and therefore the buoyancy force. Too much buoyancy can create runaway ascent, where the lift bag 20 and the object lifted by the lift bag 20 rises too quickly.

The buoyancy regulator device 50 is used to control the amount of air that is within internal cavity 34 to control the lift force that is generated by lift bag 20. The buoyancy regulator device 50 is positioned within internal cavity 34 so that it may communicate with lift bag slot 42 that is defined through lift bag body 24. The buoyancy regulator device 50 provides an opening that opens the internal cavity 34 of lift bag body 24 to a determined water level. This allows excess air volume within internal cavity 34 that is created during ascent of the lift bag 20 to be released into the outside environment through lift bag slot 42. The release of the excess air prevents an increase of buoyancy and in lift force to help prevent runaway during ascent of the lift bag 20. In some embodiments, as described further below, the position of the opening provided by buoyancy regulator device along lift bag slot 42 may be adjusted to allow a diver to regulate the amount of lift force provided by lift bag 20.

Figure 2:
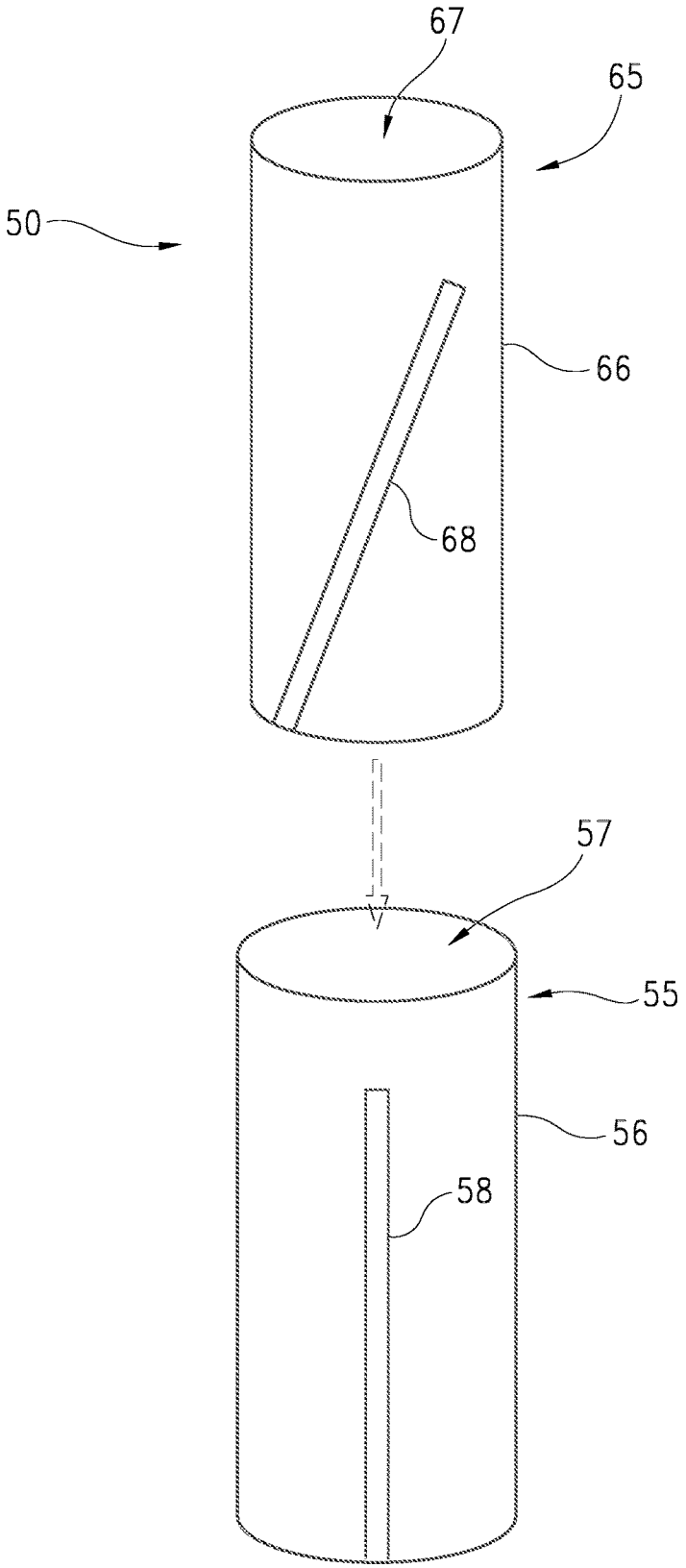
FIG. 2 illustrates an exploded view of an embodiment of a buoyancy regulator device for the lift bag shown in FIG. 1.

An exploded view of an embodiment of a buoyancy regulator device 50 is shown in FIG. 2. Buoyancy regulator device 50 includes an outer regulator tube 55. Outer regulator tube 55 has a hollow outer regulator tube body 56 that surrounds and defines an outer regulator tube interior 57. An outer regulator tube opening is defined through a portion of outer regulator tube body 56 and allows fluid communication between the outer regulator tube interior 57 and the environment outside the outer regulator tube body 56. In the embodiment shown in FIG. 2, the outer regulator tube opening is an outer regulator tube slot 58. However, in other embodiments the outer regulator tube opening may be any shape that allows for fluid communication between the outer regulator tube interior 57 and the outer regulator tube body 56.

The outer regulator tube slot 58 is oriented vertically along outer regulator tube body 56, generally perpendicular to the top and bottom edges of outer regulator tube body 56. In some embodiments, the outer regulator tube slot 58 may be shaped and sized to correspond with the lift bag slot 42 defined through lift bag body 24. The outer regulator tube slot 58 may be milled through outer regulator tube body 56 or may be formed by any other suitable process.

Buoyancy regulator device 50 also includes an inner regulator tube 65 that fits concentrically within outer regulator tube 55. Inner regulator tube 65 has a hollow inner regulator tube body 66 that surrounds and defines an inner regulator tube interior 67. An inner regulator tube slot 68 is defined through inner regulator tube body 66 and is in fluid communication with the inner regulator tube interior 67. Inner regulator tube slot 68 is positioned on inner regulator tube body 66 so that inner regulator tube slot 68 is oriented at an oblique angle with respect to outer regulator tube slot 58 when inner regulator tube 65 is concentric with outer regulator tube 55. Although the outer regulator tube slot 58 and inner regulator tube slot 68 are shown extending through the bottom edge of the outer regulator tube 55 and the inner regulator tube 65, respectively, in other embodiments, the outer regulator tube slot 58 and the inner regulator tube slot 68 may stop short of the bottom edge of the outer regulator tube 55 and the inner regulator tube 65.

Figure 3A:
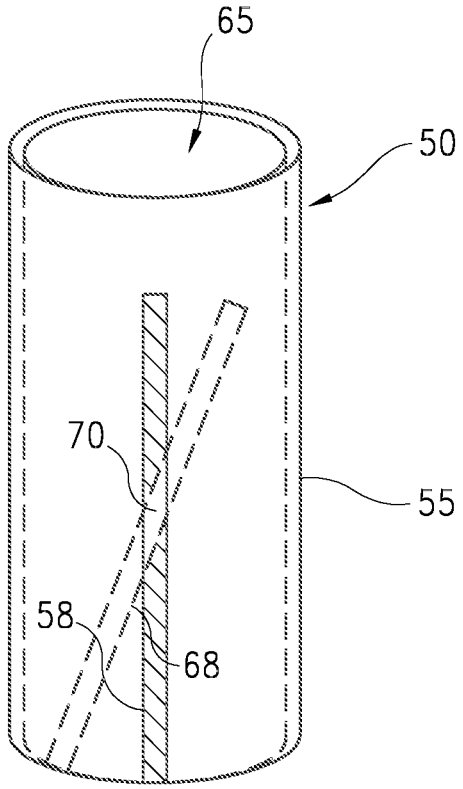
FIG. 3A illustrates a front elevation view of the buoyancy regulator device shown in FIG. 2.

As shown in FIG. 3A, when the inner regulator tube 65 is inserted within the outer regulator tube interior 57, the inner regulator tube slot 68 and the outer regulator tube slot 58 align to create a regulator tube aperture 70. The size of regulator tube aperture 70 is limited by the intersection of inner regulator tube slot 68 and outer regulator tube slot 58 so that the portions of the regulator tube slots 58, 68 that are not aligned are blocked by the regulator tube bodies 56, 66 and do not allow fluid communication between the regulator tube interiors 57, 67 and the outside environment. Inner regulator tube 65 may be retained within outer regulator tube 55 by a retainer ring or any other suitable method of retention to keep the regulator tubes 55, 65 vertically aligned and to prevent any movement between the regulator tubes 55, 65 other than rotation.

Figure 3B:
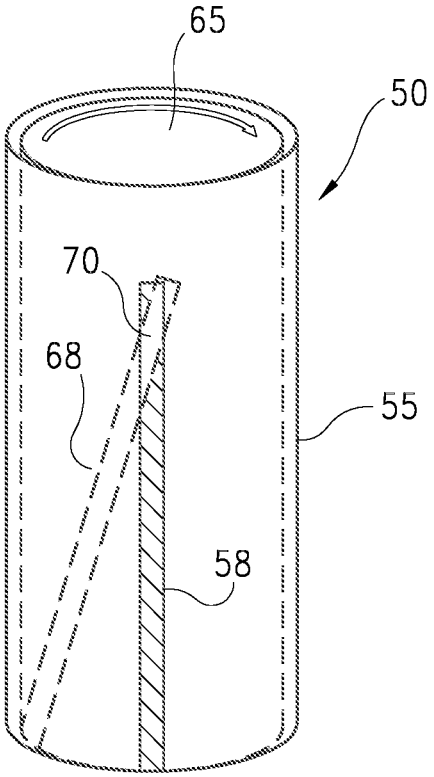
FIG. 3B illustrates a front elevation view of the buoyancy regulator device shown in FIG. 3A after rotation of the regulator tube to adjust the position of the regulator tube opening.

Because inner regulator tube slot 68 is arranged at an oblique angle with respect to outer regulator tube slot 58, the position of regulator tube aperture 70 can be changed by rotating inner regulator tube 65 within outer regulator tube 55. In the embodiment shown in FIG. 3B, rotating inner regulator tube 65 clockwise within outer regulator tube 55 moves the regulator tube aperture 70 vertically upward along outer regulator tube 55. However, in other embodiments, the position of regulator tube aperture 70 can be changed by rotating outer regulator tube 55 with respect to inner regulator tube 65.

Rotation of the regulator tubes 55, 65 may be accomplished in any suitable fashion. In one embodiment, the top of the inner regulator tube 65 and/or the outer regulator tube 55 may be accessible on the exterior of lift bag body 24 to allow rotation of one of or either of the regulator tubes 55, 65 by hand. In another embodiment, a small handle accessible by a diver may be operationally connected to either of the regulator tubes 55, 65 to allow a user to rotate one of the regulator tubes 55, 65 to adjust the position of regulator tube aperture 70. In other embodiments, the regulator tubes 55, 65 may be accessible by a diver reaching within internal cavity 34 of lift bag body 24 through opening 38 in the bottom portion 27 of lift bag 20.

The position of regulator tube aperture 70 may be used to regulate the volume of air that is contained within the lift bag 20 shown in FIG. 1, and therefore regulates the amount of lift force that is provided by the lift bag 20. Air that is introduced into lift bag 20 is able to remain within lift bag body 24 above the position of regulator tube aperture 70. However, when the volume of the air exceeds the volume of the interior of lift bag body 24 above the regulator tube aperture 70, the excess air exits lift bag 20 through regulator tube aperture 70 and the corresponding lift bag slot 42. Therefore, adjusting the position of regulator tube aperture 70 to be closer to the top portion 26 of lift bag 20 decreases the volume of air within lift bag body 24 and decreasing the buoyancy force. Similarly, adjusting the position of regulator tube aperture 70 to be closer to the bottom portion 27 of lift bag 20 increases the volume of air that can be held within lift bag body 24 and increases the buoyancy force.

The buoyancy regulator device 50 automatically regulates the buoyancy force provided by the lift bag 20 even as the lift bag 20 is ascending and the volume of air within the lift bag body 24 increases due to decreased water depth and water pressure. The excess volume of air that is created during ascent is released from lift bag body 24 through regulator tube aperture 70 so that the volume of air within lift bag body 24, and therefore the buoyancy, remains constant. The constant volume of air prevents the risk of runaway as the lift bag 20 ascends. The vertical position of regulator tube aperture 70 can be preset by a diver to create a specific volume of air within lift bag body 24 that provides a desired lift force for the object that is to be lifted underwater. This desired lift force remains unchanged as the lift bag 20 ascends because the excess air created within lift bag body 24 due to decreased water pressure is expelled through regulator tube aperture 70.

Figure 4:
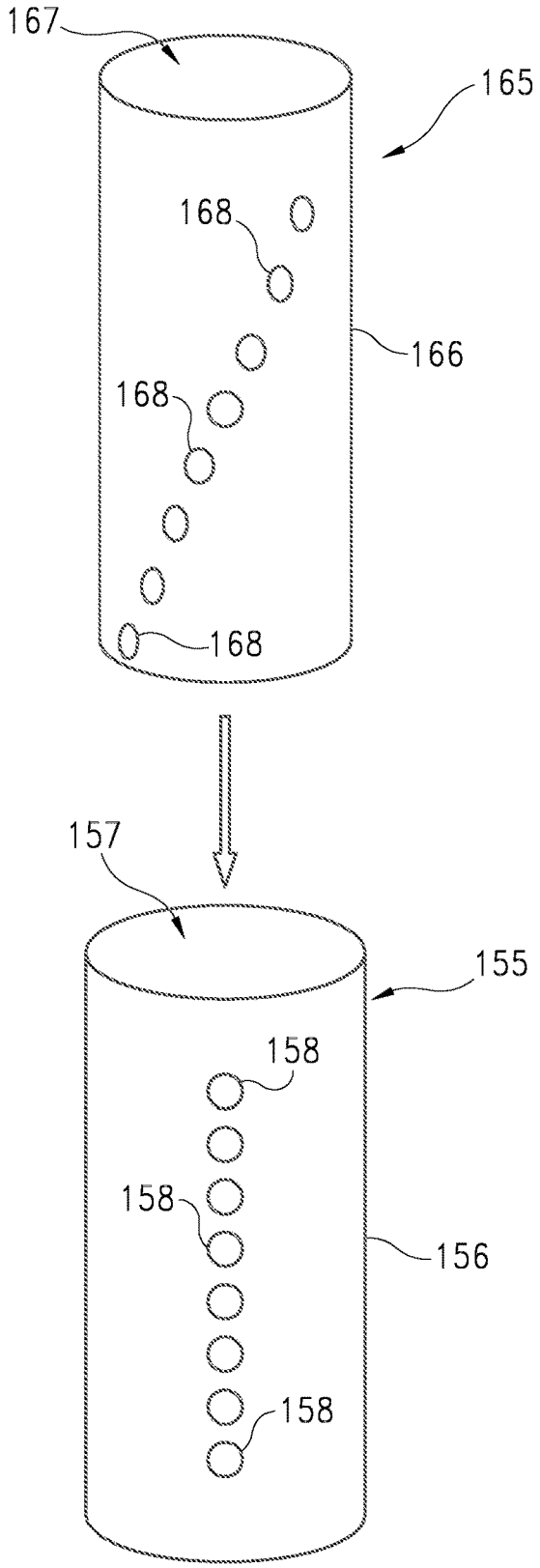
FIG. 4 illustrates an exploded view of an embodiment of a buoyancy regulator device for the lift bag shown in FIG. 1.

FIG. 4 illustrates an alternative embodiment of a buoyancy regulator device 150. Buoyancy regulator device 150 includes an outer regulator tube 155 and an inner regulator tube 165 that is capable of fitting concentrically within outer regulator tube 155. Instead of including a slot for the regulator tube opening as shown in FIGS. 2-3, the outer regulator tube opening for the outer regulator tube 155 is represented as a series of outer regulator tube holes 158 that extend through an outer regulator tube body 156 and that are in fluid communication with an outer regulator tube interior 157. The inner regulator tube opening for the inner regulator tube 165 is represented by a series of inner regulator tube holes 168 that extend through an inner regulator tube body 166 and that are in fluid communication with an inner regulator tube interior 167.

Figure 5A:
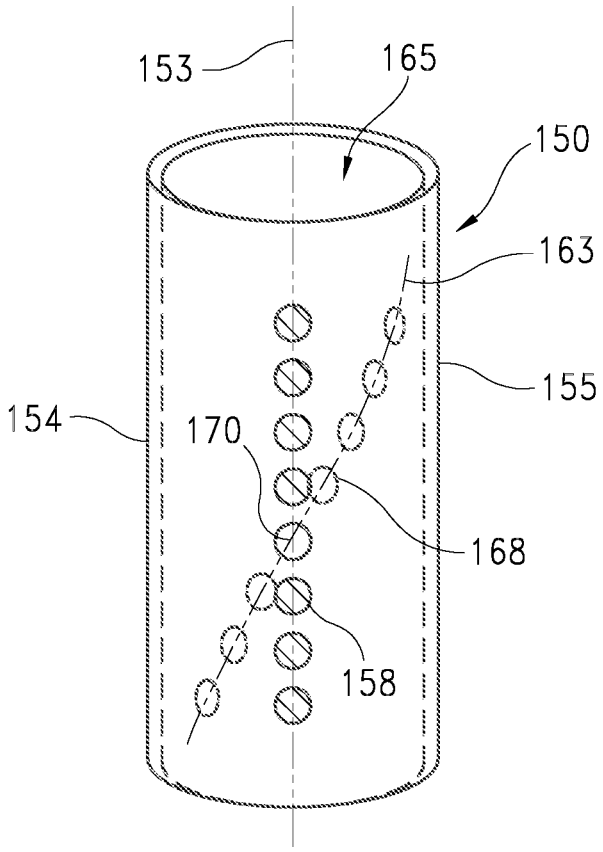
FIG. 5A illustrates a front elevation view of the buoyancy regulator device shown in FIG. 4.
Figure 5B:
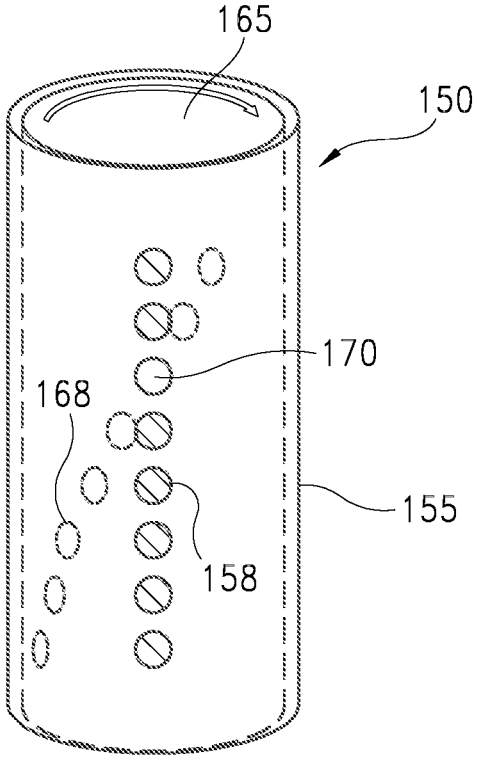
FIG. 5B illustrates a front elevation view of the buoyancy regulator device shown in FIG. 5A after rotation of the regulator tube to adjust the position of the regulator tube opening.

Outer regulator tube holes 158 are aligned vertically on outer regulator tube body 156. As shown in FIGS. 5A and 5B, the inner regulator tube holes 168 are aligned on inner regulator tube body 166 along an axis 163 that is oblique to an axis 153 aligned through the centers of the outer regulator tube holes 158, when the inner regulator tube 165 is concentric with the outer regulator tube 155. Therefore, when the inner regulator tube 165 is concentric with outer regulator tube 155, a single inner regulator tube hole 168 is aligned with a single outer regulator tube hole 158 to create a regulator tube aperture 170. In this embodiment, the axis 153 extending through the centers of the outer regulator tube holes 158 is substantially parallel to a sidewall 154 of the outer regulator tube 155.

As shown in FIG. 5B, the position of the regulator tube aperture 170 may be changed by rotating the regulator tubes 155, 165 with respect to each other so that different corresponding regulator tube holes 158, 168 are aligned. In FIG. 5B, the inner regulator tube 165 is rotated clockwise so that the position of the regulator tube aperture 170 moves vertically upward to decrease the volume of air that can be held within lift bag 20. Likewise, rotating the inner regulator tube 165 counterclockwise would move the position of the regulator tube opening vertically downward to increase the volume of air that can be held within lift bag 20.

Figure 6:
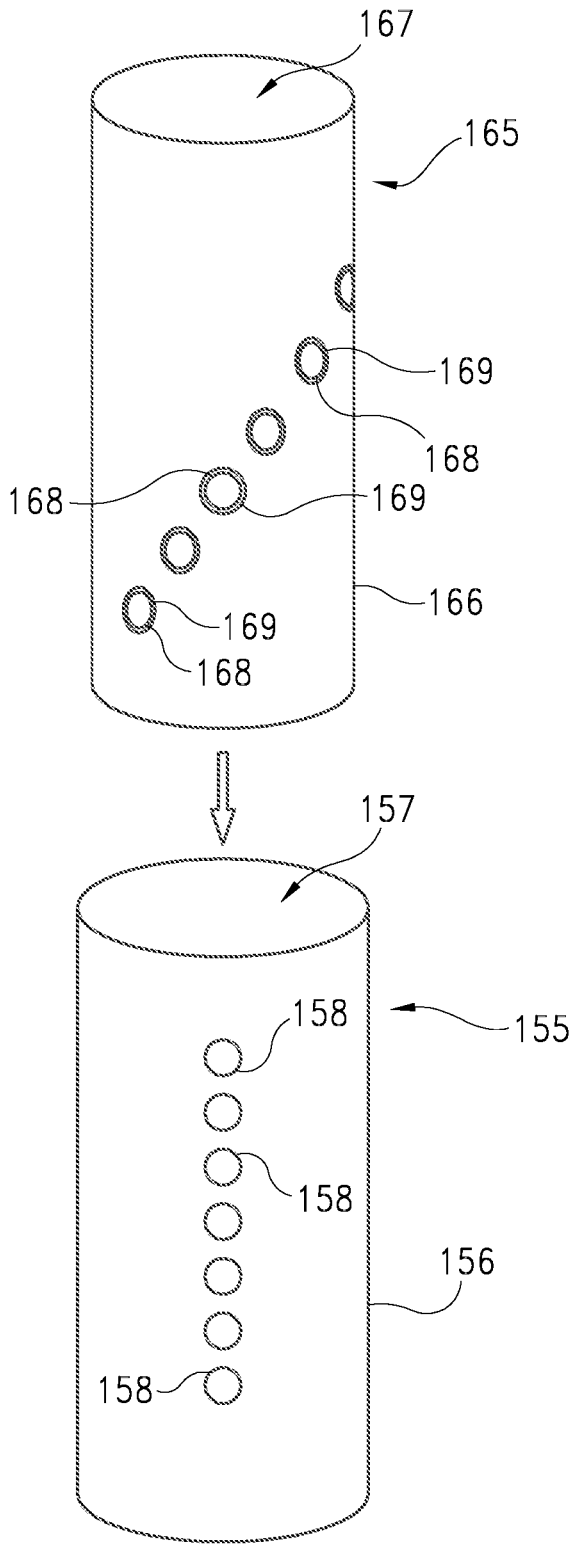
FIG. 6 illustrates a front elevation view of the buoyancy regulator device shown in FIG. 4 including seals surrounding the regulator holes.

In some embodiments, as shown in FIG. 6, seals 169 may surround the inner regulator tube holes 168 to provide an additional seal between the inner regulator tube 165 and the outer regulator tube 155 when the inner regulator tube 165 is concentrically located within the outer regulator tube interior 157. In some embodiments, these seals 169 are O-rings that surround the inner regulator tube holes 168. In other embodiments, the seals 169 may be positioned on the inner surface of the outer regulator tube body 156 and surround the outer regulator tube holes 158.

Figure 7:
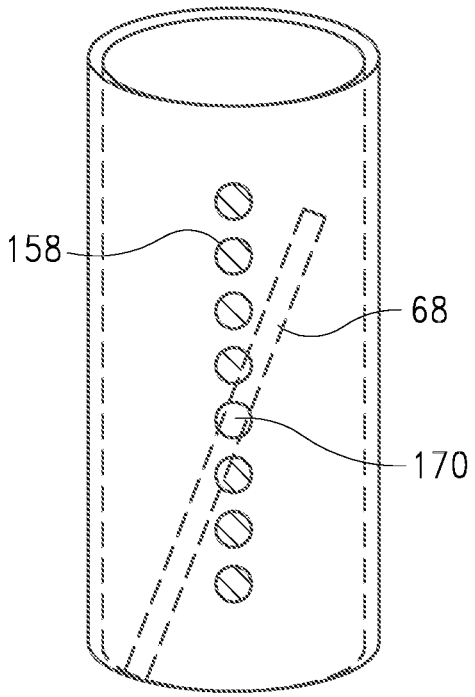
FIG. 7 illustrates a front elevation view of an embodiment of a buoyancy regulator device for the lift bag shown in FIG. 1.

Although the embodiment shown in FIGS. 4-5, both the inner regulator tube 165 and the outer regulator tube 155 include circular regulator tube holes 158, 168, as shown in FIG. 7, inner regulator tube 65 may be combined with outer regulator tube 155 to combine the angled inner regulator tube slot 68 from inner regulator tube 65 with the circular regulator tube holes 158 from outer regulator tube 155. The angled inner regulator tube slot 68 may align with one of the circular regulator tube holes 158 to determine the position of the regulator tube aperture 170 and corresponding lift force for the lift bag 20.

Figure 8:
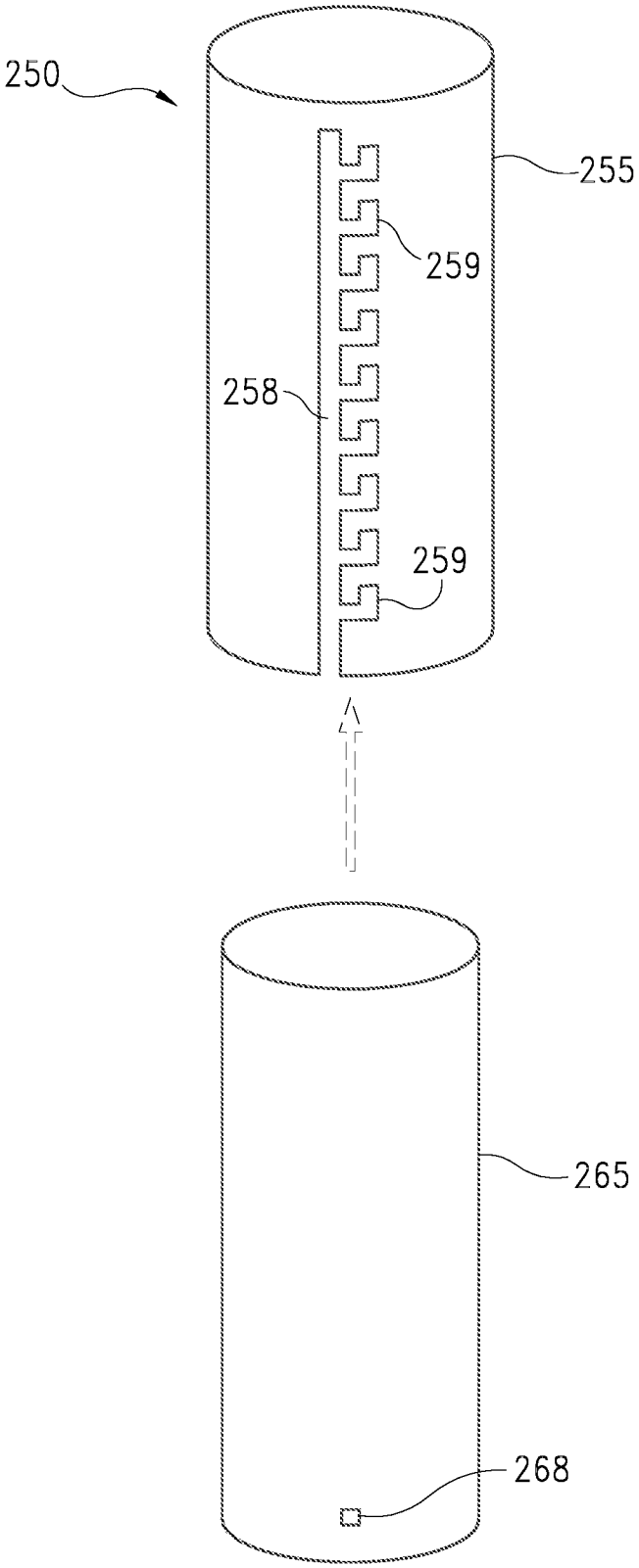
FIG. 8 illustrates an exploded view of an embodiment of a buoyancy regulator device for the lift bag shown in FIG. 1.
Figure 9:
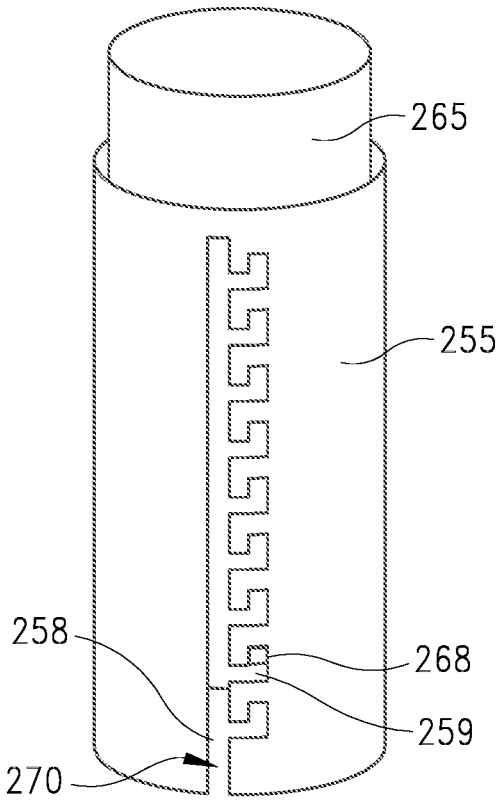
FIG. 9 illustrates a front elevation view of the buoyancy regulator device shown in FIG. 8.

Another embodiment of a buoyancy regulator device 250 is shown in FIGS. 8-9. Buoyancy regulator device 250 includes an outer regulator tube 255 and an inner regulator tube 265. The outer regulator tube opening takes the form of an outer regulator tube slot 258 that includes a series of tube slot arms 259 is defined through outer regulator tube 255. Outer regulator tube slot 258 is configured to correspond with lift bag slot 42 on lift bag 20. Inner regulator tube 265 includes a stud 268 protruding from inner regulator tube 265 that is able to fit into and slide within outer regulator tube slot 258.

As shown in FIG. 9, inner regulator tube 265 may be inserted within outer regulator tube 255 so that inner regulator tube 265 is concentric with outer regulator tube 255, when stud 268 is aligned with outer regulator tube slot 258. When stud 268 is aligned with a tube slot arm 259, inner regulator tube 265 may be rotated with respect to outer regulator tube 255 so that stud 268 enters tube slot arm 259. The stud 268 can rest within tube slot arm 259 and prevent further rotation of the inner regulator tube 265 with respect to outer regulator tube 255. In some embodiments, the tube slot arms 259 may be positioned at pre-specified increments of air displacement to correspond to certain amounts of lift force. For example, each tube slot arm 259 may correspond to either an increase or a decrease of 1 pound of lift force or, in some embodiments, each tube slot arm 259 may correspond to an increase or a decrease of 10 pounds of lift force.

The stud 268 can be moved to align with different tube slot arms 259 along outer regulator tube slot 258 by sliding inner regulator tube 265 through outer regulator tube 255. The height of the regulator tube aperture 270 formed beneath the inner regulator tube 265 is adjusted by inserting stud 268 into different tube slot arms 259 along outer regulator tube slot 258. Adjusting the height of regulator tube aperture 270 modifies the volume of air that is held within lift bag body 24 and therefore controls the lift force applied by lift bag 20. As excess air volume is created upon ascent of the lift bag 20, the extra air is discharged from lift bag body 24 through the regulator tube aperture 270.

Other embodiments may include different adjustment methods for positioning the regulator tube aperture 70 created by the buoyancy regulator device 50. As an example, in one embodiment, the buoyancy regulator device 50 may include a rack and pinion system. A handle on the rack and pinion system is rotated to disengage the teeth and the handle may then be moved vertically to determine a desired height for the regulator tube opening. Once the desired height is reached, the handle is rotated in the opposite direction to reengage the teeth and hold the system in place.

It should be recognized by a person of ordinary skill in the art that the arrangement of the regulator tube openings on the inner regulator tube and outer regulator tubes may be switched in alternative embodiments. As an example, for buoyancy regulator device 50, the inner regulator tube slot 68 may be a vertical slot that is substantially parallel to a sidewall of the inner regulator tube body 66 and the outer regulator tube slot 58 may be angled with respect to a sidewall of the outer regulator tube body 56. In this embodiment, the outer regulator tube 55 is rotated with respect to the inner regulator tube 65 to adjust the position of the regulator tube aperture 170.

As another example, for buoyancy regulator device 150, the inner regulator tube holes 168 may be aligned along an axis that is substantially parallel to a sidewall of the inner regulator tube body 166, and the outer regulator tube holes 158 may be aligned along an axis that is angled with respect to a sidewall of the outer regulator tube body 156. In this embodiment, the outer regulator tube 155 is rotated with respect to the inner regulator tube 165 to adjust the position of the regulator tube aperture 170.

Similarly, for buoyancy regulator device 250, the stud 268 may be located on an inner surface of the outer regulator tube 255 and the regulator tube slot 258 and tube slot arms 259 may be defined through the inner regulator tube 265. In this embodiment, the outer regulator tube 255 is translated and rotated with the respect to the inner regulator tube 265 to adjust the height of the regulator tube aperture 270.

Figure 10:
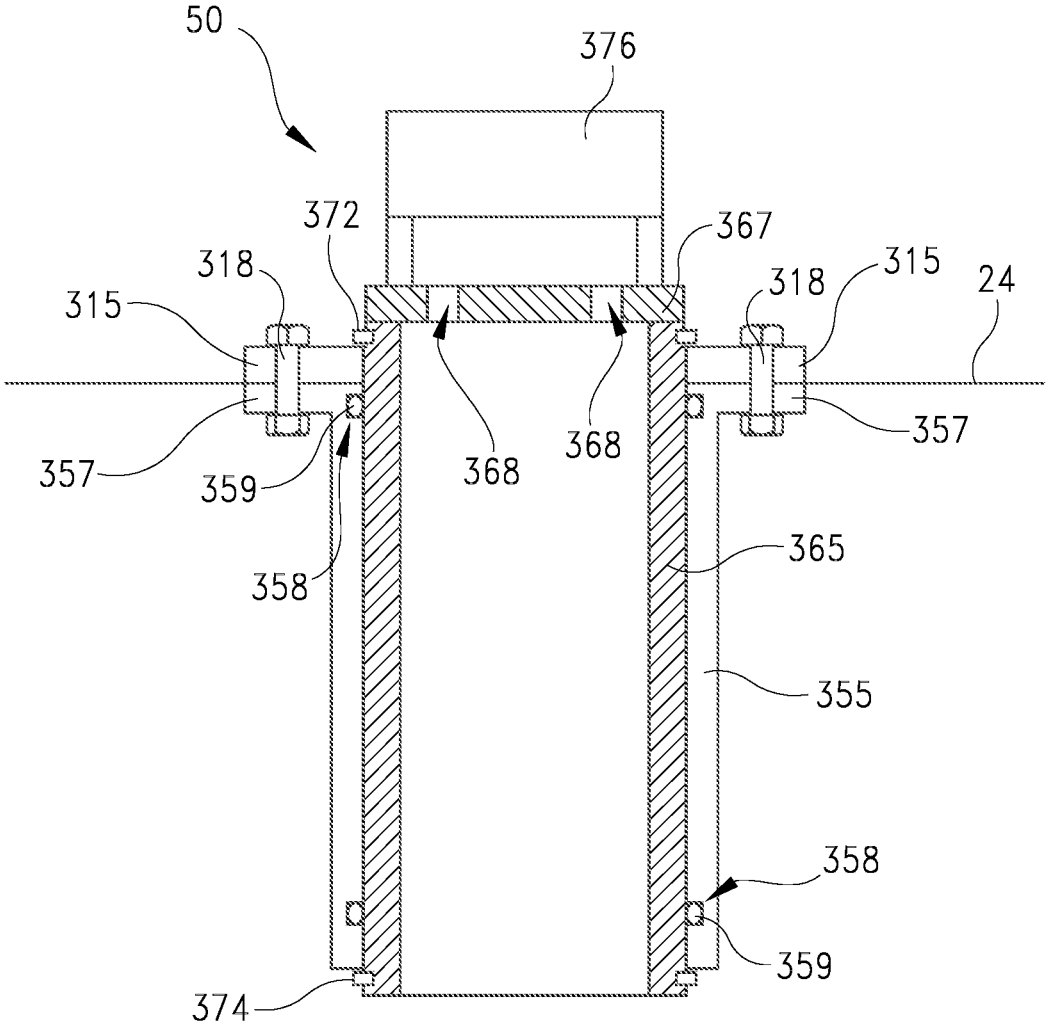
FIG. 10 illustrates a cross-sectional view of a buoyancy regulator device with a handle attached to a lift bag.

FIG. 10 illustrates an embodiment of the buoyancy regulator device 50 and an example of a method of attaching the buoyancy regulator device 50 to a lift bag 20. An outer regulator tube 355 is positioned on the interior of lift bag body 24 and an inner regulator tube 365 is positioned concentrically within outer regulator tube 355. O-ring grooves 358 are defined in outer regulator tube 355 and O-rings 359 are seated within O-ring grooves 358 to provide a seal between outer regulator tube 355 and the concentric inner regulator tube 365.

A top flange 315 is positioned on the exterior of lift bag body 24 and surrounds the inner regulator tube 365 and aligns with a top surface 357 of the outer regulator tube 355. A flange bolt 318 extends through the top flange 315, the lift bag body 24, and the outer regulator tube 355 to attach the buoyancy regulator device 50 to the lift bag 20. In some embodiments, a top retainer ring 372 is positioned between the top flange 315 and the inner regulator tube 365 to prevent inner regulator tube 365 from sliding vertically within outer regulator tube 355. An additional bottom retainer ring 374 may be positioned around the bottom of inner regulator tube 365.

Inner regulator tube includes an inner tube cover 367. A vent hole 368 or multiple vent holes 368 may be defined through inner tube cover 367 cover for allowing excess air to escape. A handle 376 is attached to inner tube cover 367 and positioned so that the handle is on the exterior of lift bag body 24. Rotation of handle 376 causes rotation of inner regulator tube 365 with respect to outer regulator tube 355, changing the orientation of an inner regulator tube slot on inner regulator tube 365 with respect to an outer regulator tube slot on outer regulator tube 355 to adjust the desired lift force provided by the lift bag 20. In some embodiments, markings may be made on the handle or on the top flange 315 to give a visual indication to the diver as to the position of inner regulator tube 365 with respect to the outer regulator tube 355 so that the diver can easily discern the buoyancy force provided by the lift bag 20. The markings could directly indicate the position of the regulator tubes 355, 365, or may be translated to show the effective buoyancy force provided by the lift bag based on the position of the regulator tubes 355, 365.

Figure 11:
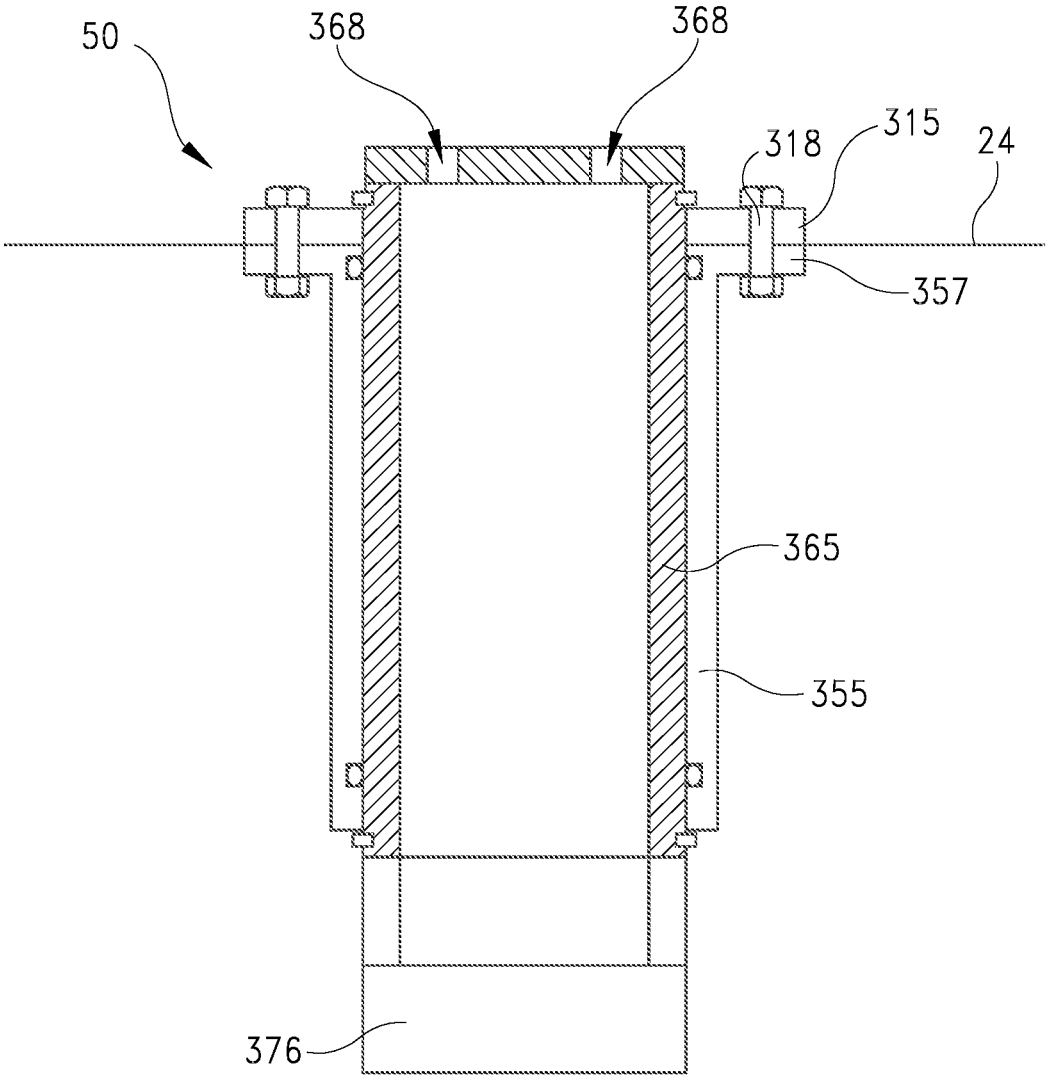
FIG. 11 illustrates a cross-sectional view of an alternative embodiment of the buoyancy regulator device of FIG. 10 with the handle attached on a bottom edge of an inner regulator tube of the buoyancy regulator device.
Figure 12:
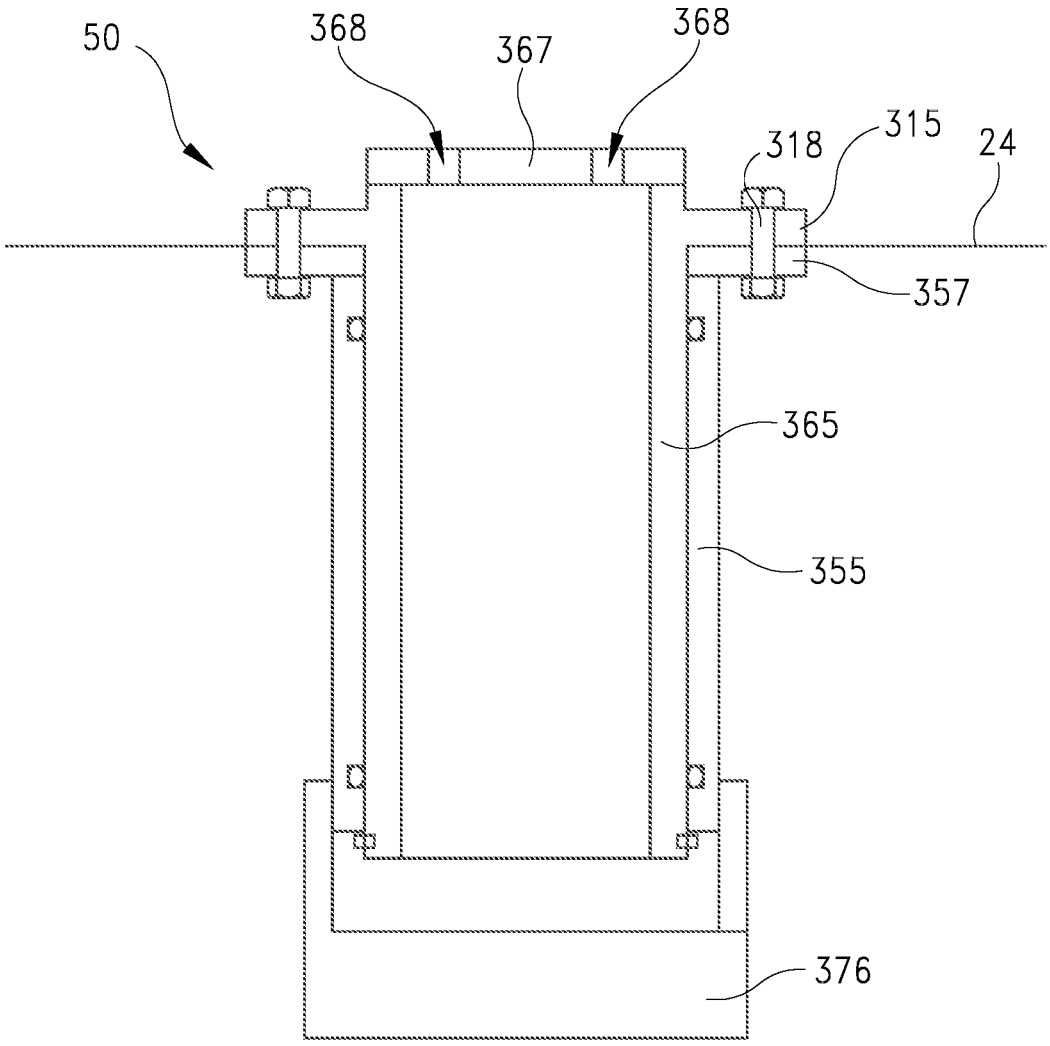
FIG. 12 illustrates a cross-sectional view of an alternative embodiment of the buoyancy regulator device of FIG. 10 with the handle attached to an outer regulator tube of the buoyancy regulator device.

Alternative embodiments of the buoyancy regulator device 50 are shown in FIGS. 11-12. In FIG. 11, the handle 376 is attached to the bottom edge of inner regulator tube 365. Rotation of handle 376 rotates inner regulator tube 365 with respect to outer regulator tube 355. In FIG. 12, handle 376 is attached to outer regulator tube 355 so that rotation of handle 376 causes rotation of the outer regulator tube 355 with respect to the inner regulator tube 365. In some embodiments, the handle 376 may be positioned within the internal cavity 34 of the lift bag 20 so that a diver reaches into internal cavity 34 to rotate handle 376. In other embodiments, the handle 376 extends through internal cavity 34 so that it extends below opening 38 of the lift bag 20 and can be rotated without needing to reach within internal cavity 34. Some embodiments include multiple handles 376. As an example, one handle 376 is on the exterior of the lift bag 20 and a second handle 376 extends into the internal cavity 34 of the lift bag 20 (for example, see FIG. 15).

Figure 13:
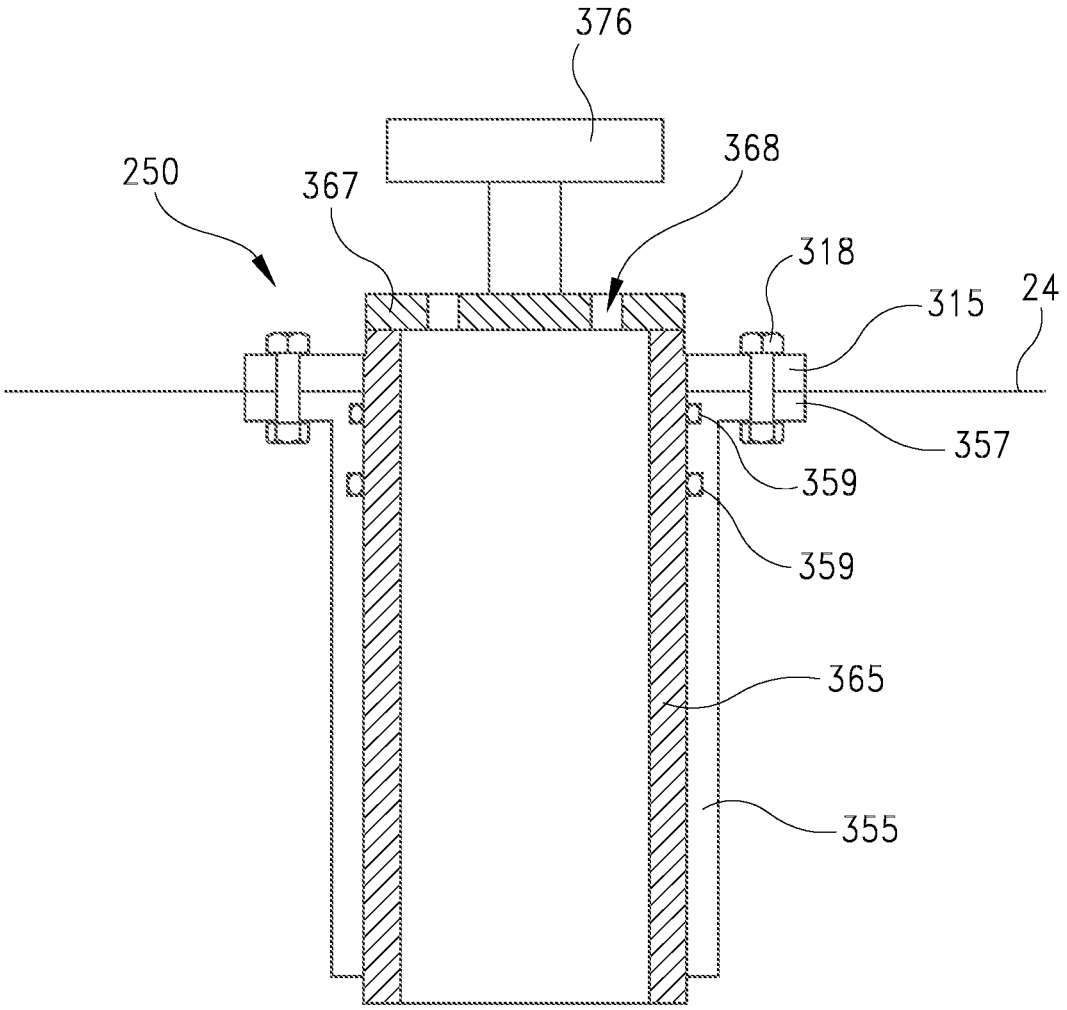
FIG. 13 illustrates a cross section view of the buoyancy regulator device of FIG. 8 with a handle attached on a top edge of the inner regulator tube.
Figure 14:
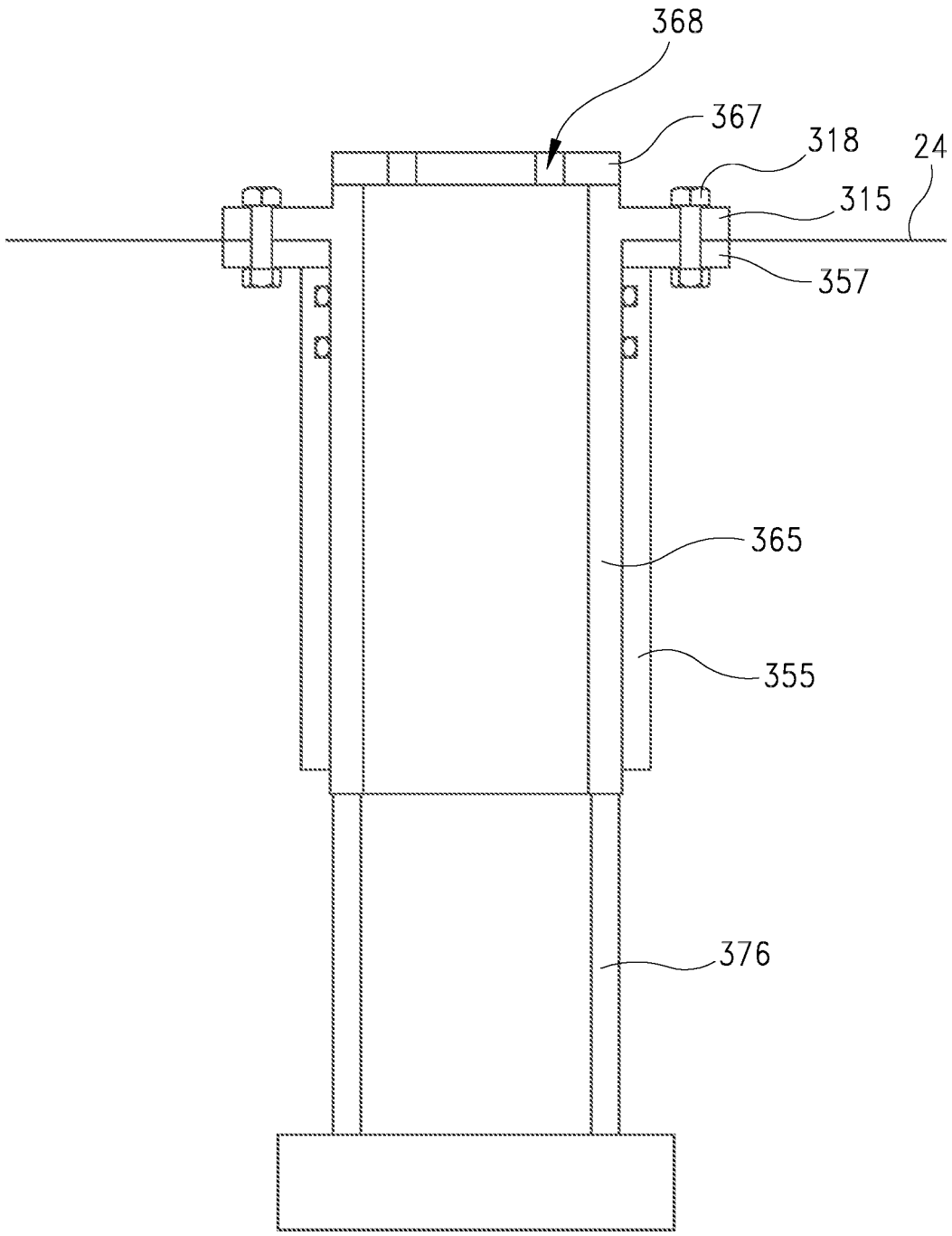
FIG. 14 illustrates a cross section view of an alternative embodiment of the buoyancy regulator device of FIG. 13 with the handle attached on a bottom edge of the inner regulator tube.

Alternative embodiments of the buoyancy regulator device 250 having the stud and slot arrangement are shown in FIGS. 13-14. In FIG. 13, the handle 376 is attached to the inner tube cover 367. The top retainer ring 372 and bottom retainer ring 374 shown in FIG. 10 have been removed to allow inner regulator tube 365 to translate within outer regulator tube 355 when handle 376 is pushed and/or pulled. Handle 376 may also be rotated to allow inner regulator tube 365 to rotate with respect to outer regulator tube 355. FIG. 14 is similar to FIG. 13, but the handle 376 is instead connected to the bottom edge of inner regulator tube 365. Pushing or pulling handle 376 allows translation of inner regulator tube 365 within outer regulator tube 355, while rotating handle 376 causes inner regulator tube 365 to rotate with respect to outer regulator tube 355.

In other embodiments, handle 376 may be included on any of the embodiments of buoyancy regulator device 50, 150, 250 as desired. Handle 376 may be attached to the buoyancy regulator device 50, 150, or 250 on the portion of the buoyancy regulator device 50, 150, or 250 that is exterior of the lift bag 20 or on the interior of the lift bag 20. Some embodiments may include a handle 376 that is exterior to the lift bag 20 and another handle 376 that extends within the interior of the lift bag 20.

Figure 15:
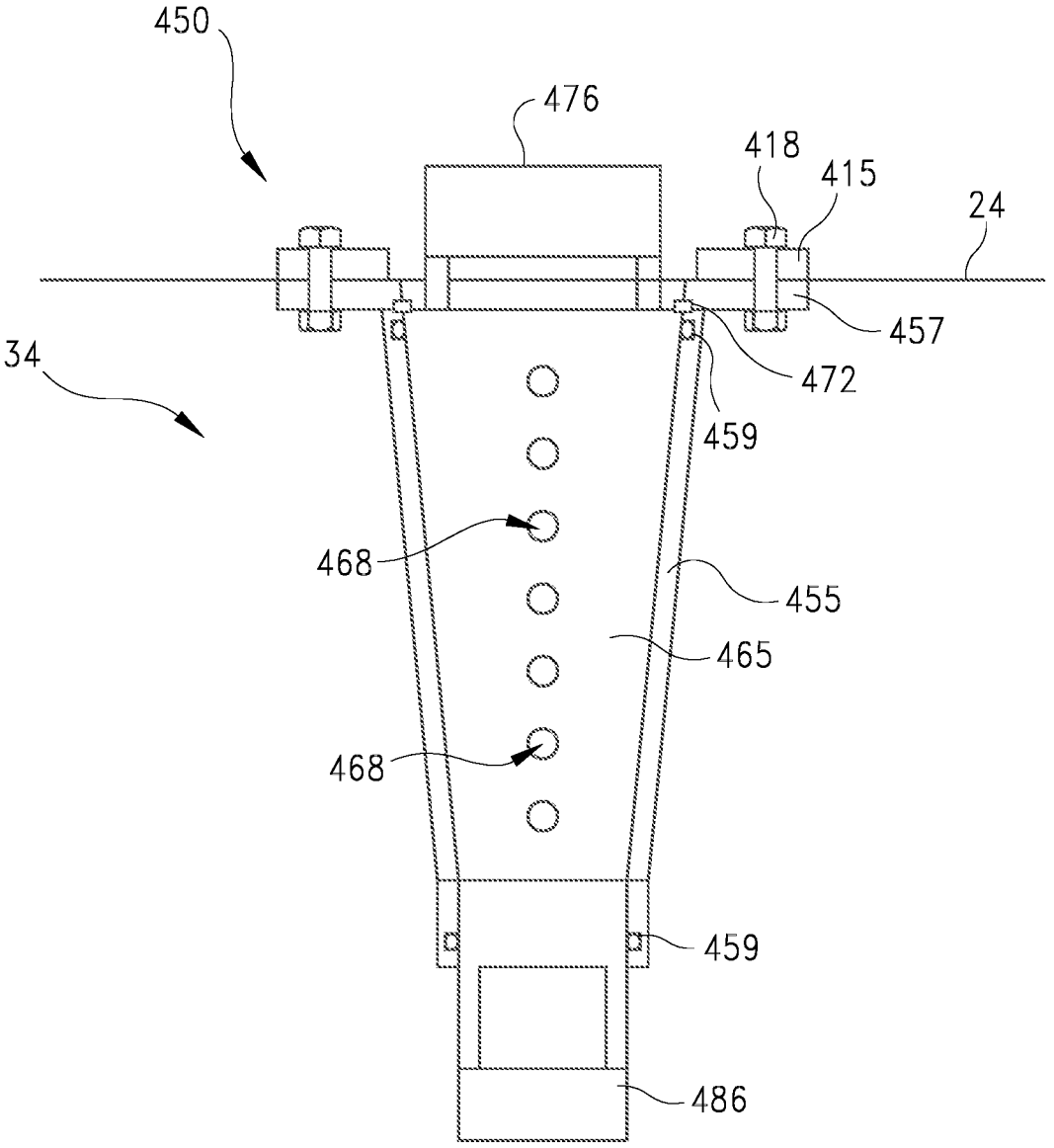
FIG. 15 illustrates a cross section view of an embodiment of a buoyancy regulator device that includes conically shaped regulator tubes.

FIG. 15 illustrates a cross-sectional view of an alternative embodiment of a buoyancy regulator device 450. Buoyancy regulator device 450 includes a conically shaped outer regulator tube 455 and a conically shaped inner regulator tube 465 that fits concentrically within outer regulator tube 455. The inner regulator tube 465 includes inner regulator tube holes 468 that may be aligned with an outer regulator tube slot as described in the embodiments discussed above.

A top flange 415 is positioned on the exterior of lift bag body 24 and aligns with a top surface 457 of the outer regulator tube 455. A flange bolt 418 extends through the top flange 415, the lift bag body 24, and the outer regulator tube 455 to attach the buoyancy regulator device 450 to the lift bag 20. A top retainer ring 472 is positioned adjacent the top surface 457 of the outer regulator tube 455 to prevent inner regulator tube 465 from moving vertically within outer regulator tube 455. O-rings 459 may also be positioned between inner regulator tube 465 and outer regulator tube 455 to provide a seal and further assist in preventing vertical movement of inner regulator tube 465 with respect to outer regulator tube 455. The O-rings 459 also provide a lubricated contact point between the outer regulator tube 455 and the inner regulator tube 465 to improve the ability of the regulator tubes 455, 465 to rotate with respect to each other or to translate with respect to each other smoothly.

A top handle 476 is attached to a top surface of the inner regulator tube 465 so that the top handle 476 extends to the exterior of the lift bag body 24 and lift bag 20. A bottom handle 486 is attached to a bottom surface of the inner regulator tube 465 so that the bottom handle 486 extends within the internal cavity 34 of lift bag 20. A diver may rotate inner regulator tube 465 with respect to outer regulator tube 455 by rotating either the top handle 476 or the bottom handle 486. This provides the diver with an option in instances where it may be easier for the diver to access either the top handle 476 or access the bottom handle 486 to adjust the desired buoyancy force provided by buoyancy regulator device 450.

FIG. 15 shows that the inner regulator tube 465 and the outer regulator tube 455 are conically shaped so that surfaces of the regulator tubes 455, 465 are wider near the surface of the lift bag body 24 and become narrower extending into the internal cavity 34 of the lift bag 20. However, in other embodiments, the regulator tubes 455, 465 may be narrower near the surface of the lift bag body and become wider extending into the internal cavity 34 of the lift bag 20.

Although lift bag 20 and buoyancy regulator device 50 have thus far been described generally in terms of controlling the ascent of an object underwater, buoyancy regulator device 50 may also be used to control the descent of an object to an underwater location using a lift bag 20. For descent, lift bag 20 is filled with a volume of air that is small enough to create neutral buoyancy where there is some buoyancy force, but not enough buoyancy force to cause the object to ascend. As the object descends, the volume of air in the lift bag decreases, so that the buoyancy force provided by the air trapped within lift bag 20 also decreases. Without the addition of extra air, this causes the object to sink faster. However, a diver may provide additional air to lift bag 20 to increase the air volume. By setting the buoyancy regulator device 50 to a desired air volume, any air added to the lift bag 20 that is in excess of the desired air volume is released from the internal cavity 34 of lift bag body 24, and a constant lift force is maintained to maintain a steady speed for descent.

The application of lift bag 20 for a controlled descent greatly improves safety when compared to a typical descent that involves the use of weight anchors. Anchors may sink quickly and dangerously with little ability to regulate the speed of descent. The lift bag 20 allows divers to use tag lines to maintain a safe distance from the descending object and allows the desired object to descent in a controlled manner.

The concentric tube design for the buoyancy regulator device 50 provides several advantages for the regulation of air volume and lift force created by a lift bag. Because the buoyancy regulator device 50 is found within the interior of lift bag body 24, there are no exterior entanglement hazards that could be caught or snagged on objects found underwater such as algae, jellyfish, or other obstacles such as fishing or anchor lines. Additionally, the relatively few moving parts and connection points provide for only a few possible points of failure, even in situations under increased water pressure.

Dump valves that are commonly used for manually releasing excess air in a lift bag will sometimes stick or not seat correctly. This could cause more air to escape than is intended by the diver, creating negative buoyancy and causing the lift bag to sink rather than rise. In response, the diver may need to use air from their own breathing apparatus to add additional air to offset the loss caused by the stuck dump valve. The buoyancy regulator device 50 eliminates the need for a manual dump valve and reduces the risk of excess air escaping form lift bag 20.

The buoyancy regulator device 50 is compact and only causes a small air volume displacement within the internal cavity 34 of lift bag 20, so that there is a minimal impact on the lift capacity of lift bag 20. The compactness also makes buoyancy regulator device 50 easy to attach to diver gear.

Buoyancy regulator device 50 may be included as a component of a new lift bag or may be sold as a standalone unit that is capable of being retrofitted into an existing, standard lift bag that does not have buoyancy control. Buoyancy regulator device 50 can be modified to accommodate many different types of lift bags from small lift bags to industrial lift bags.

The mechanical nature of the buoyancy regulator device 50 means that no batteries, chemical agents, or electricity is needed to operate the buoyancy regulator device 50. This increases safety for a diver operating the lift bag 20 and reduces the risk of environmental damage caused by any of these types of hazards. This also minimizes the cost of upkeep and continued use, as the buoyancy regulator device 50 is easy to clean and does not require replacement of components such as chemicals, batteries, valves, solenoids, or sensors.

Additionally, multiple lift bags 20 may be used to lift a large, unbalanced load without requiring multiple divers to be present to monitor each individual lift bag 20. Typically, a diver needs to be stationed near each lift bag to manually regulate the lift capacity of the lift bag during ascent or descent. However, since the lift bags 20 are capable of automatically regulating the lift force without intervention by a diver, multiple divers are not necessary to monitor each of the lift bags 20 used.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A lift bag comprising:

a lift bag body defining an internal cavity;

a lift bag slot defined through a portion of said lift bag body, wherein said lift bag slot is configured to allow fluid communication between said internal cavity and an environment external of said lift bag body;

a buoyancy regulator device positioned within said internal cavity of said lift bag body, wherein said buoyancy regulator device includes:

an outer regulator tube including an outer regulator tube body that defines an outer regulator interior, wherein an outer regulator tube opening is defined through said outer regulator tube body and said outer regulator tube opening is in fluid communication with said outer regulator interior;

an inner regulator tube including an inner regulator tube body that defines an inner regulator tube interior, wherein an inner regulator tube opening is defined through said inner regulator tube body and said inner regulator tube opening is in fluid communication with said inner regulator interior, and wherein said inner regulator tube fits concentrically within said outer regulator tube interior;

wherein said outer regulator tube opening is configured to align with the inner regulator tube opening to create a regulator tube aperture, and wherein a position of said regulator tube aperture is adjustable by moving one of said inner regulator tube and said outer regulator tube with respect to the other regulator tube;

wherein said lift bag slot is in fluid communication with said regulator tube aperture to allow excess air within said internal cavity of said lift bag body to be expelled through said regulator tube aperture and said lift bag slot; and wherein adjusting the position of said regulator tube aperture adjusts a buoyancy force provided by the lift bag.

2. The lift bag of claim 1, wherein said inner regulator tube is rotatable with respect to said outer regulator tube when said inner regulator tube is positioned within said outer regulator tube interior.

3. The lift bag of claim 1, wherein said outer regulator tube is rotatable with respect to said inner regulator tube when said inner regulator tube is positioned within said outer regulator tube interior.

4. The lift bag of claim 1, wherein said outer regulator tube opening is a vertical slot.

5. The lift bag of claim 4, wherein said inner regulator tube opening is a slot that is positioned at an oblique angle with respect to the vertical slot when said inner regulator tube is positioned within said outer regulator tube interior.

6. The lift bag of claim 1, wherein said outer regulator tube opening is a series of outer regulator tube holes.

7. The lift bag of claim 6, wherein said inner regulator tube opening is a series of inner regulator tube holes aligned along an axis that is to oblique an axis of said series of outer regulator tube holes when said inner regulator tube is positioned concentrically within said outer regulator tube interior.

8. The lift bag of claim 7, wherein an O-ring surrounds each of the inner regulator tube holes to form a seal between said inner regulator tube and said outer regulator when said inner regulator tube is positioned within said outer regulator tube interior.

9. The lift bag of claim 1, wherein said outer regulator tube opening is a series of outer regulator tube holes aligned along a vertical axis; and wherein said inner regulator tube opening is an angled slot that is positioned at an oblique angle with respect to the vertical axis of said series of outer regulator tube holes when said inner regulator tube is positioned within said outer regulator tube interior.

10. The lift bag of claim 1, further comprising:

a top flange positioned on an external side of said lift bag, wherein said top flange is aligned with a top surface of the outer regulator tube; and a flange bolt, wherein said flange bolt extends through said top flange, said lift bag body, and said outer regulator tube to attach the buoyancy regulator device to the lift bag body.

11. The lift bag of claim 10, wherein said top flange surrounds said inner regulator tube when said inner regulator tube is positioned within said outer regulator tube interior.

12. The lift bag of claim 1, further comprising:

a handle; and wherein said handle is attached to said inner regulator tube to allow the position of the inner regulator tube to be modified with respect to the outer regulator tube.

13. A buoyancy regulator device for a lift bag comprising:

an outer regulator tube including an outer regulator tube body that defines an outer regulator tube interior;

a plurality of outer regulator tube holes defined through said outer regulator tube body, wherein an outer regulator tube hole axis is defined through said outer regulator tube holes;

an inner regulator tube including an inner regulator tube body that defines an inner regulator tube interior, wherein said inner regulator tube is configured to fit concentrically within said outer regulator tube interior;

a plurality of inner regulator tube holes defined through said inner regulator tube body;

wherein said inner regulator tube holes are aligned along an inner regulator tube hole axis that is oblique to said outer regulator tube hole axis when said inner regulator tube is fit concentrically with said outer regulator tube interior; and wherein rotating one of said inner regulator tube or said outer regulator tube with respect to the other regulator tube when said inner regulator tube is fit concentrically within said outer regulator tube interior aligns one of said plurality of inner regulator tube holes with one of said plurality of outer regulator tube holes to determine a buoyancy force provided by the lift bag.

14. The buoyancy regulator device of claim 13, wherein said inner regulator tube is rotatable with respect to said outer regulator tube.

15. The buoyancy regulator device of claim 13, wherein said outer regulator tube is rotatable with respect to said inner regulator tube.

16. The buoyancy regulator device of claim 13, wherein said outer regulator tube hole axis is substantially parallel to a sidewall of outer regulator tube body.

17. The buoyancy regulator device of claim 13, wherein said inner regulator tube hole axis is substantially parallel to a sidewall of inner regulator tube body.

18. A buoyancy regulator device for a lift bag comprising:

an outer regulator tube including an outer regulator tube body that defines an outer regulator tube interior;

an inner regulator tube including an inner regulator tube body, wherein said inner regulator tube is configured to fit concentrically within said outer regulator tube interior;

wherein said outer regulator tube and said inner regulator tube are mechanically coupled by a stud fit into a tube slot, wherein said tube slot includes a length and a plurality of tube slot arms extending from said tube slot each at a different position along the length of said tube slot;

wherein when said stud is aligned with one of said tube slot arms along said length of said tube slot, said outer regulator tube and said inner regulator tube may be rotated with respect to each other so that said stud enters said tube slot arm; and wherein a buoyancy force of said lift bag is adjusted by positioning said stud within a different tube slot arm.

19. The buoyancy regulator device of claim 18, wherein said tube slot is defined through said outer regulator tube; and wherein said stud extends from said inner regulator tube.

20. The buoyancy regulator device of claim 18, wherein said tube slot is defined through said inner regulator tube; and wherein said stud extends from said outer regulator tube.

* * * * *